US006330950B1

(12) United States Patent
Loika

(10) Patent No.: US 6,330,950 B1
(45) Date of Patent: Dec. 18, 2001

(54) HOCKEY STICK MOUNTING ASSEMBLY

(76) Inventor: Steve Loika, 1240 Highway F, Defiance, MO (US) 63341

( * ) Notice: Subject to any disclaimer, the term of this patent is extended or adjusted under 35 U.S.C. 154(b) by 0 days.

(21) Appl. No.: 09/665,022

(22) Filed: Sep. 19, 2000

(51) Int. Cl.[7] ..... A47F 7/00
(52) U.S. Cl. ..... 211/85.7; 211/87.01; D6/552
(58) Field of Search ..... 211/85.7, 87.01, 211/13.1; 248/309.1; D6/552

(56) References Cited

U.S. PATENT DOCUMENTS

D. 168,850 * 2/1953 Monroe .
D. 243,804 * 3/1977 Underwood et al. ..... D6/552
D. 291,154 * 8/1987 Owen .
D. 362,755 * 10/1995 Ehrmann ..... D6/552 X
D. 380,027 * 6/1997 Ferguson ..... D6/552 X
D. 390,013 * 2/1998 Ho ..... D6/569
D. 417,113 * 11/1999 Greaney et al. ..... D6/552
D. 422,438 * 4/2000 Saldivar ..... D6/552
5,913,431 * 6/1999 Rathien ..... 211/85.7

* cited by examiner

*Primary Examiner*—Robert W Gibson, Jr.
(74) *Attorney, Agent, or Firm*—Henry W. Cummings

(57) ABSTRACT

In accordance with the present invention, a hockey stick is displayed by fitting it into cutouts in each of two standard or simulated hockey pucks. In the first embodiment, a standard hockey stick is displayed resting in two hockey pucks centered vertically on a plaque. In the second embodiment, a goalie stick is displayed resting in two hockey pucks offset vertically to compensate for the different design of the stick.

13 Claims, 4 Drawing Sheets

HOCKEY STICK MOUNTING ASSEMBLY

I FIELD OF THE INVENTION

The invention relates to a method to display sports paraphernalia, specifically a hockey stick. The invention utilizes authentic or simulated hockey pucks specially modified and mounted on a plaque so as to provide support for the hockey stick.

II BACKGROUND OF THE INVENTION

U.S. Pat. No. 2,099,332 discloses a reversible hanger mounting for pictures and the like. This invention is a piece of hardware with the primary purpose of allowing a picture to be hung one of two ways: Either from a nail or screw, or from a wire or cord.

U.S. Pat. No. 2,354,622 discloses a decorative plaque. The invention is designed to be mounted to the wall in a variety of ways and to support a variety of decorative elements. The decorative elements may be removed for moving or storage.

U.S. Pat. No. 4,211,022 discloses a picture frame. The primary purpose of the invention is to display a photograph, painting, or other item carried on a relatively thin piece of sheet material.

U.S. Pat. No. 4,775,129 discloses a wall hanger. The primary purpose of the invention is to provide a means to hang a picture or other item on a wall by various means, including nails, screws, and wire. It is designed to be attached to the item under display.

U.S. Pat. No. 5,248,121 discloses a dual-purpose support apparatus for use in taxidermy. The invention is a single-piece sheet metal stamping designed to mount a game fish or other fauna to a plaque or directly to a wall.

III SUMMARY OF THE INVENTION

A. OBJECTS OF THE INVENTION

One object of the present invention is to provide a means to display a hockey stick using authentic or simulated hockey pucks modified for the purpose and mounted to a plaque.

Another object of the present invention is to provide a means to display a different style hockey stick, preferably a goalie stick, using authentic or simulated hockey pucks modified for the purpose and mounted to a plaque in a different manner from the first embodiment.

B. SUMMARY

In accordance with the present invention, display 10 includes plaque 20, modified or simulated hockey pucks 40, 42, and fastening means 30 for example keyhole fasteners 32. Plaque 20 may be made of wood, plastic, or other suitable material and may have decorative edges. The dimensions of the plaque can vary depending upon the desired display size. Two hockey pucks 40, 42 are standard or simulated pucks modified to include slots 44 and flat sides 46, as shown in FIG. 9. Hockey pucks 40, 42 are attached to plaque 20 by means of fastening means 30, for example common drywall screws 33, or other suitable fasteners, through holes 34, 35, 36 as shown in FIG. 5. Keyhole fasteners 32 are attached to the back side of plaque 20 by means of common wood screws. A hockey stick to be displayed will rest in cutouts 44 made into modified hockey pucks 40, 42. A hockey stick 50 to be displayed will rest in cutouts 44 made into modified hockey pucks 40, 42.

IV. THE DRAWINGS

V. DESCRIPTION OF PREFERRED EMBODIMENTS

Figure 1:
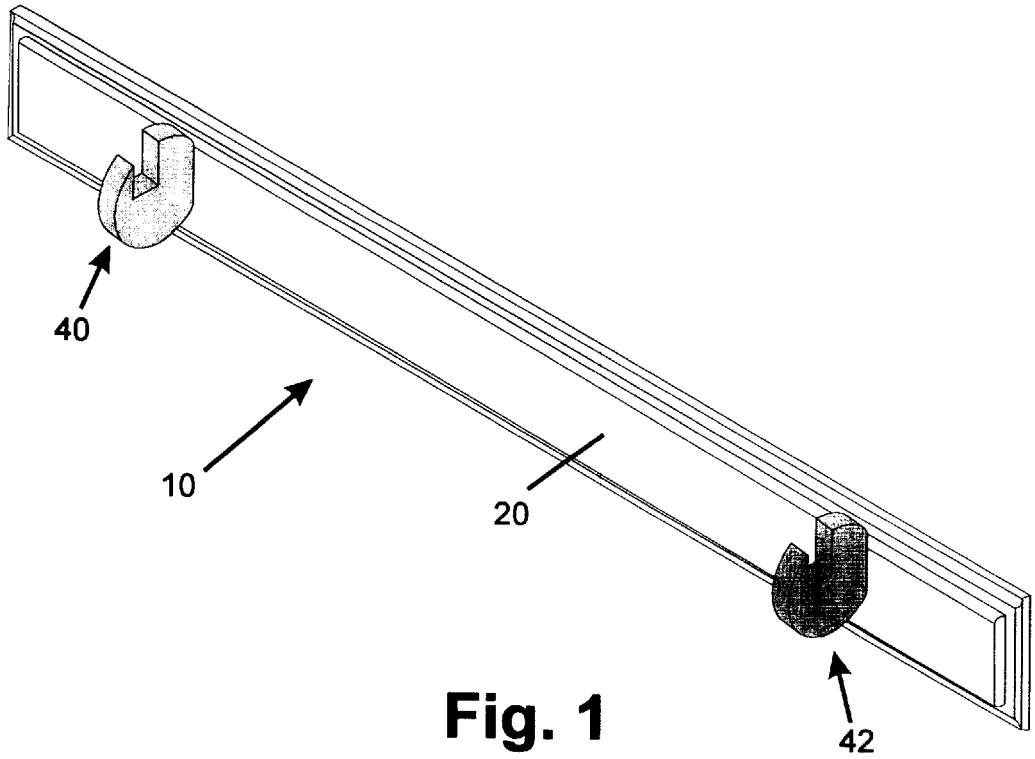
FIG. 1 is a perspective view of the first embodiment of the invention, showing its capability of displaying a standard hockey stick.
Figure 2:
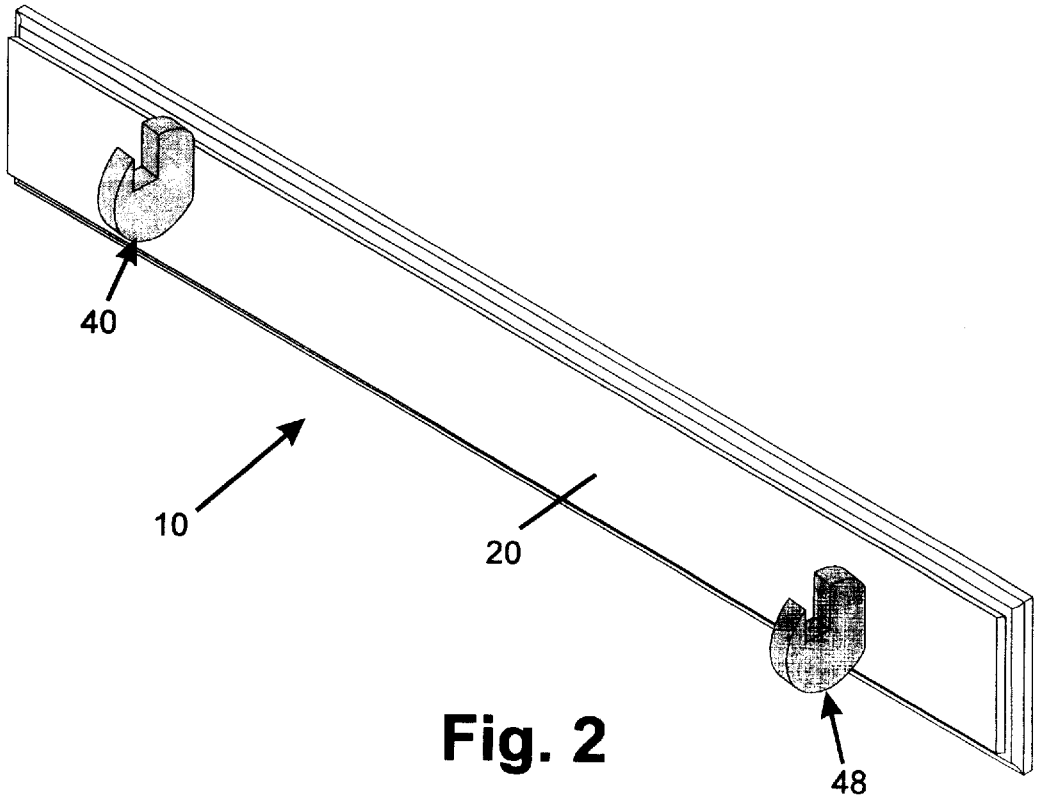
FIG. 2 is a perspective view of a second embodiment of the invention, showing its capability of displaying a goalie stick.
Figure 3:
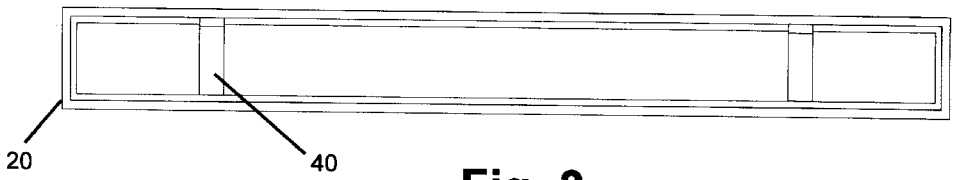
FIG. 3 is a front view of a first embodiment of the invention.
Figure 6:
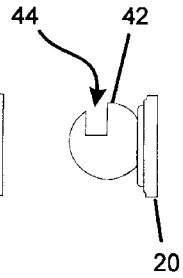
FIG. 6 is an end view of FIG. 3.
Figure 4:
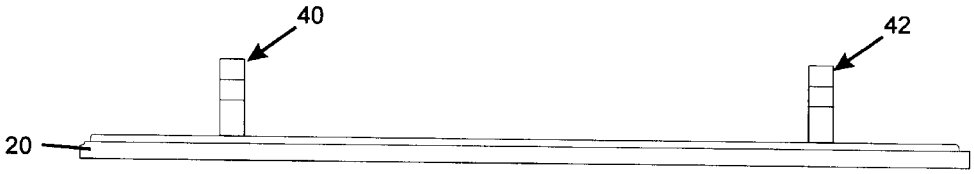
FIG. 4 is a top view of a first embodiment of the invention.
Figure 5:
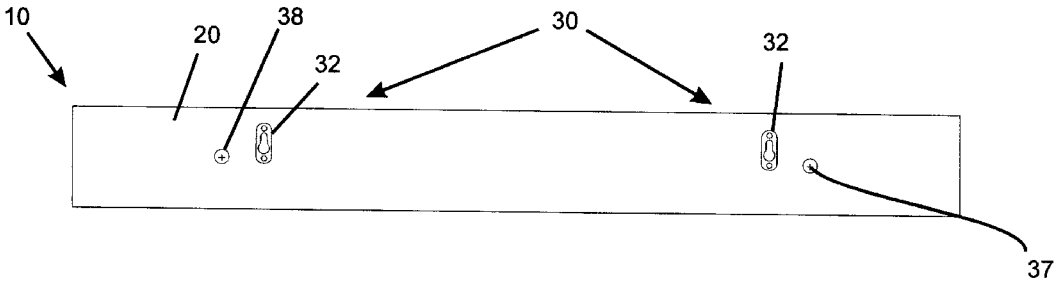
FIG. 5 is a rear view showing how the hockey pucks are mounted on the plaque.

In accordance with the present invention, display 10 includes plaque 20, modified hockey pucks 40, 42, and fastening means 30.

The two hockey pucks 40, 42 are standard or simulated hockey pucks modified to include slots 44 and flat surface 46.

Figure 7:
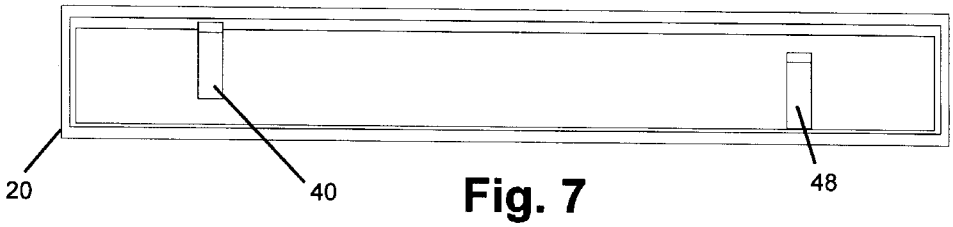
FIG. 7 is a front view of another embodiment.
Figure 8:
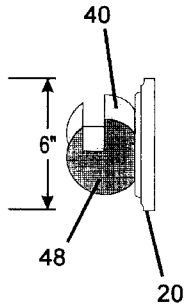
FIG. 8 is an end view of FIG. 7.
Figure 9:
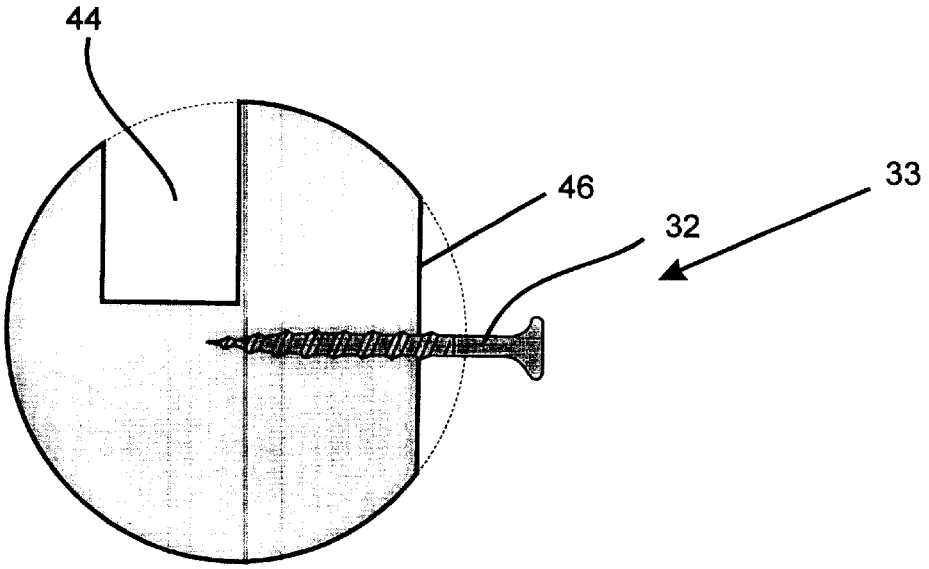
FIG. 9 is a detail view of the puck and fastener.
Figure 10:
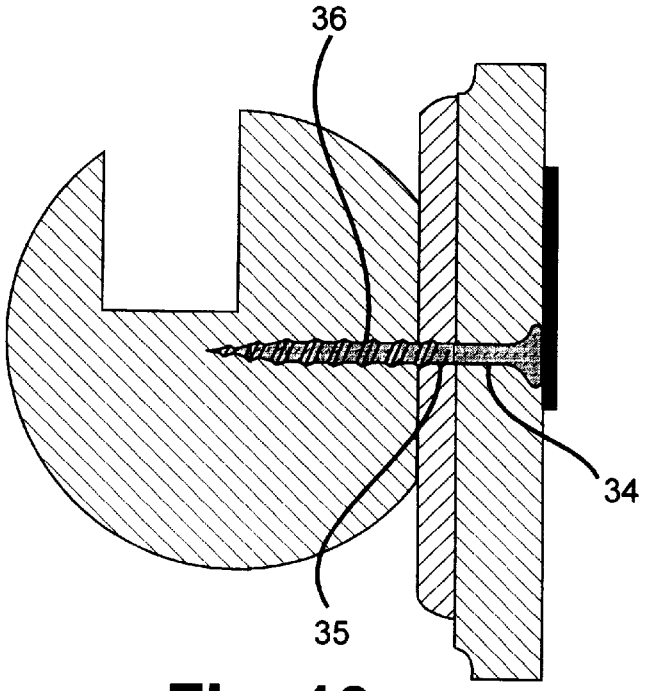
FIG. 10 is a sectional view showing how the hockey pucks are mounted on the plaque.
Figure 11A:
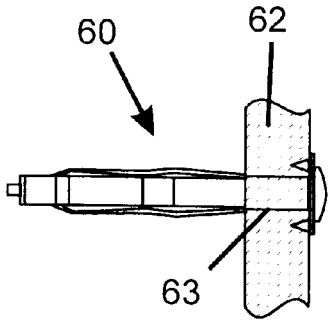
FIG. 11A is a side elevation view of a first step in installing a moly anchor.
Figure 11B:
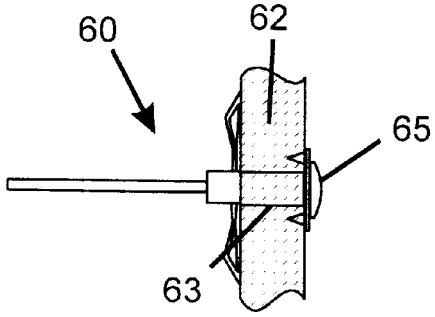
FIG. 11B is a side elevation view of a second step in installing a moly anchor.
Figure 11C:
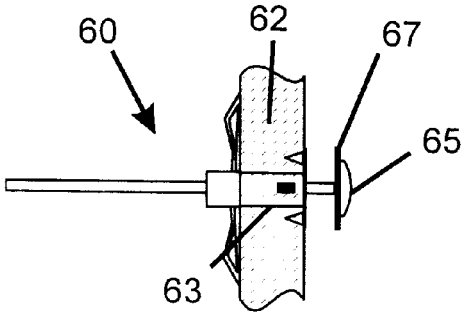
FIG. 11C is a side elevation view of a third step in installing a moly anchor.

Keyhole fasteners 32 are attached to the back side of plaque 20 by means of common wood screws 37 Then for example common drywall screws 33, or other suitable fasteners extend through holes 34, 35, 36 as shown in FIG. 10. A hockey stick to be displayed will rest in cutouts 44. The goalie stick support puck 48 is spaced vertically below puck 40 in the second embodiment shown in FIGS. 7 and 8, and will support goalie stick 52.

Display 10 may be mounted to a wall as follows: Drill a small hole 63 in the wall 62 and push a moly anchor 60 through the hole. Screw in moly anchor bolt 65 until anchor 60 is tight in the wall. Unscrew bolt 65 about ⅛" to ¼", making sure black washer 67 is away from the wall. Drill another hole 63 approximately 16" away from the first hole (ALWAYS MEASURE the distance between the keyhole brackets) and push a moly anchor 60 through the hole. Screw in moly anchor bolt 65 until anchor 60 is tight in the wall. Unscrew bolt 65 about ⅛" to ¼", making sure black washer 67 is away from the wall. The keyhole brackets on the back of display 10 will slide onto the screws.

What is claimed is:

1. A special purpose plaque for displaying a standard hockey stick comprising:

a plaque;

at least two simulated or authentic hockey pucks, each puck having a generally cylindrical external surface including an upper surface containing a slot extending downwardly into said puck;

means for attaching to said plaque said at least two simulated or authentic hocky pucks at a laterally spaced apart location on said plaque, said pucks having means for supporting at least one hockey stick.

2. A display assembly according to claim 1 wherein said means for attaching comprises at least two mechanical fasteners.

3. A display assembly according to claim 1 wherein said plaque is made out of wood, plastic, or other suitably decorative material.

4. A display assembly according to claim 3 having decorative edges molded or routed into it.

5. An assembly according to claim 1 wherein said plaque is hung on the wall by means of two keyhole fasteners attached to its rear side.

6. An assembly according to claim 5 wherein said plaque is hung on the wall by fastening means selected from hollow wall anchors, screws, and nails.

7. An assembly according to claim 6 wherein said hockey pucks are vertically spaced on the front of the plaque.

8. An assembly for displaying a goalie stick comprising:

a plaque having attached to it two authentic or simulated hockey pucks vertically spaced apart each puck having a generally cylindrical surface including an upper surface containing a slot extending downwardly into said puck; and at least two mechanical fasteners extending through said plaque and respectively, into said pucks.

9. An assembly according to claim 8 wherein said plaque is made from a material selected from wood, plastic, or other suitably decorative material.

10. An assembly according to claim 9 wherein said plaque includes decorative edges molded or routed into it.

11. An assembly according to claim 8 wherein said plaque is hung on the wall by means of two keyhole fasteners attached to its rear side.

12. A special purpose plaque for displaying a standard hockey stick according to claim 1 wherein said cylindrical external surface includes a flat portion to facilitate mounting on a supporting plaque.

13. A special purpose plaque for displaying a standard hockey stick according to claim 8 wherein said cylindrical external surface includes a flat portion to facilitate mounting on a supporting plaque.

* * * * *